US006637113B2

(12) United States Patent
Ikuta et al.

(10) Patent No.: US 6,637,113 B2
(45) Date of Patent: Oct. 28, 2003

(54) BLADE OF ELECTRIC SHAVER, METHOD FOR SHAVING BY USING THE SAME, AND ELECTRIC SHAVER HAVING THE SAME

(75) Inventors: Toshio Ikuta, Hikone (JP); Shigetoshi Sakon, Hirakata (JP); Tadashi Hamada, Sakai (JP); Masakatsu Araki, Hikone (JP)

(73) Assignee: Matsushita Electric Works, Ltd. (JP)

( * ) Notice: Subject to any disclaimer, the term of this patent is extended or adjusted under 35 U.S.C. 154(b) by 39 days.

(21) Appl. No.: 09/935,284

(22) Filed: Aug. 22, 2001

(65) Prior Publication Data

US 2002/0059729 A1 May 23, 2002

(30) Foreign Application Priority Data

Aug. 22, 2000 (JP) ..... 2000-251163

(51) Int. Cl.[7] ..... B26B 19/02
(52) U.S. Cl. ..... 30/43.92; 30/346.51
(58) Field of Search ..... 30/43.92, 43.9, 30/346.51, 43.91, 43.8, 223

(56) References Cited

U.S. PATENT DOCUMENTS 2,325,606 A * 7/1943 Hanley ..... 30/43.92
4,493,149 A * 1/1985 Tanahashi et al. ..... 30/43.92
5,207,731 A * 5/1993 Bukoschek ..... 30/43.92
5,893,211 A 4/1999 Hotani ..... 30/43.92

FOREIGN PATENT DOCUMENTS

JP 54-113692 8/1979
JP 10-118358 5/1998

* cited by examiner

*Primary Examiner*—Allan N. Shoap
*Assistant Examiner*—John Windmuller
(74) *Attorney, Agent, or Firm*—Rosenthal & Osha L.L.P.

(57) ABSTRACT

A blade of an electric shaver is disclosed. The blade includes an interior blade detachably attached to a drive element of the electric shaver via an interior blade pushing-up means. The interior blade includes a horizontal surface, a vertical surface, and a relief surface provided between the horizontal surface and the vertical surface, and is elastically pushed upward by the interior blade pushing-up means. The blade further includes a sheet-shaped exterior blade having a plurality of blade apertures. A bottom surface of the exterior blade is elastically contacted with the horizontal surface of the interior blade by a pushing force of the interior blade pushing-up means. Upon driving the drive element, the interior blade is moved laterally such that the horizontal surface of the interior blade rubs against the bottom surface of the exterior blade, and hair introduced into the blade aperture of the exterior blade is held between the horizontal surface of the interior blade and the exterior blade in accordance with a lateral movement of the interior blade and cut by an edge of the exterior blade.

15 Claims, 13 Drawing Sheets

BLADE OF ELECTRIC SHAVER, METHOD FOR SHAVING BY USING THE SAME, AND ELECTRIC SHAVER HAVING THE SAME

BACKGROUND OF INVENTION

The present invention relates to a blade of an electric shaver, method of shaving, and an electric shaver.

Generally, a blade of an electric shaver is provided with an exterior blade formed in a sheet-shape having a plurality of apertures, and an interior blade which slides on the bottom surface of the exterior blade relative to the exterior blade. FIG. 16 shows how a human beard (31) is shaved by using a conventional blade of an electric shaver. According to the conventional blade of an electric shaver shown in FIG. 16, a sharp edge (40) is formed at a top side end of an interior blade (3). Upon pressing the human skin (30) having the beard (31) by the electric shaver, the skin (30) protrudes beyond the exterior blade (2) through the apertures (1). Under this condition, as the interior blade (3) is moved along the surface of the skin (30), the beard (31) is introduced into the aperture (1) and is cut by the sharp edge (40) of the interior blade (3). According to the above described conventional blade of an electric shaver illustrated in FIG. 16, however, there is a drawback in that the skin (30) may be damaged by excess stimulations because the surface of the skin (30) is shaved by the interior blade (3). Also, in order for the interior blade (3) to have the sharp edge (40), the interior blade (3) needs to be precisely processed. Further, there is a risk of injury at the time of cleaning of the interior blade (3).

A conventional blade of an electric shaver disclosed by Japanese patent laid open JITSUKAIHEI 54-113692 is illustrated in FIGS. 17–19. According to this conventional blade, a plurality of convexities (50) which do not have a cutting edge (41) are partially formed along the top end of the interior blade (3). By providing such convexities (50) as a guard at the top end of the interior blade (3), damages to the skin (30) can be prevented. Under this configuration, the size of the apertures (1) of the exterior blade (2) can be set such that the beard (31) can be efficiently introduced into the apertures (1).

However, according to the above described conventional blade of an electric shaver, because sharp cutting edges (41) must be formed at the interior blade (3), damages to the skin (30) cannot be prevented except for the areas where the convexities (50) are formed. As a result, the size of the apertures (1) of the exterior blade (2) is inevitably restricted to prevent such damages. Also, if the blade (3) is formed such that only the convexities (50) contact the skin (30) and the cutting edge (41) does not directly contact the skin (30), the area of the convexities (50) becomes enlarged and the gap between the exterior blade (2) and the cutting edge (41) of the interior blade (3) becomes large. As a result, cutting performance of the blade becomes deteriorated. What is needed is, therefore, a blade of an electric shaver having good cutting performance without damaging the skin.

SUMMARY OF INVENTION

In general, in one aspect, the present invention is a blade of an electric shaver. The blade comprises an interior blade detachably attached to a drive element of the electric shaver via an interior blade pushing-up means. The interior blade comprises a horizontal surface, a vertical surface, and a relief surface provided between the horizontal surface and the vertical surface, and is elastically pushed upward by the interior blade pushing-up means. The blade further comprises a sheet-shaped exterior blade having a plurality of blade apertures. A bottom surface of the exterior blade is elastically contacted with the horizontal surface of the interior blade by a pushing force of the interior blade pushing-up means. Upon driving the drive element, the interior blade is moved laterally such that the horizontal surface of the interior blade rubs against the bottom surface of the exterior blade, and hair introduced into the blade aperture of the exterior blade is held between the horizontal surface of the interior blade and the exterior blade in accordance with a lateral movement of the interior blade and cut by an edge of the exterior blade.

In general, in one aspect, the present invention is a method for shaving hair by using a blade of an electric shaver. The blade used in this method comprises an interior blade and a sheet-shaped exterior blade. The interior blade is detachably attached to a drive element of the electric shaver via an interior blade pushing-up means and comprises a horizontal surface, a vertical surface, and a relief surface formed between the horizontal surface and the vertical surface. The exterior blade comprises a plurality of blade apertures. A bottom surface of the exterior blade is elastically contacted with the horizontal surface of the interior blade by a pushing force of the interior blade pushing-up means. By driving the drive element such that the horizontal surface of the interior blade is moved laterally to rub the bottom surface of the exterior blade, and contacting an outer surface of the exterior blade with hair such that the hair is introduced into a blade aperture of the exterior blade, the hair thus introduced into the blade aperture is held between the interior blade and the exterior blade in accordance with a lateral movement of the interior blade and cut by an edge of the exterior blade.

In general, in one aspect, the present invention is an electric shaver. The electric shaver comprises a main body having a motor therein, a frame member disposed on a top of the main body, a drive element projecting upward from an upper surface of the frame member and driven by the motor, an interior blade detachably attached to the drive element via an interior blade pushing-up means, the interior blade having a horizontal surface, a vertical surface, and a relief surface provided between the horizontal surface and the vertical surface, and elastically pushed upward by the interior blade pushing-up means, and a head attached to the frame member to cover the interior blade, the head comprising a sheet-shaped exterior blade having a plurality of blade apertures attached to the head, the bottom surface of the exterior blade elastically contacting with the horizontal surface of the interior blade. Upon driving the drive element, the interior element moves laterally such that the horizontal surface of the interior blade rubs against the bottom surface of the exterior blade, and hair introduced into the blade aperture of the exterior blade is held between the horizontal surface of the interior blade and the exterior blade in accordance with a lateral movement of the interior blade and cut by an edge of the exterior blade.

DETAILED DESCRIPTION

Figure 1:
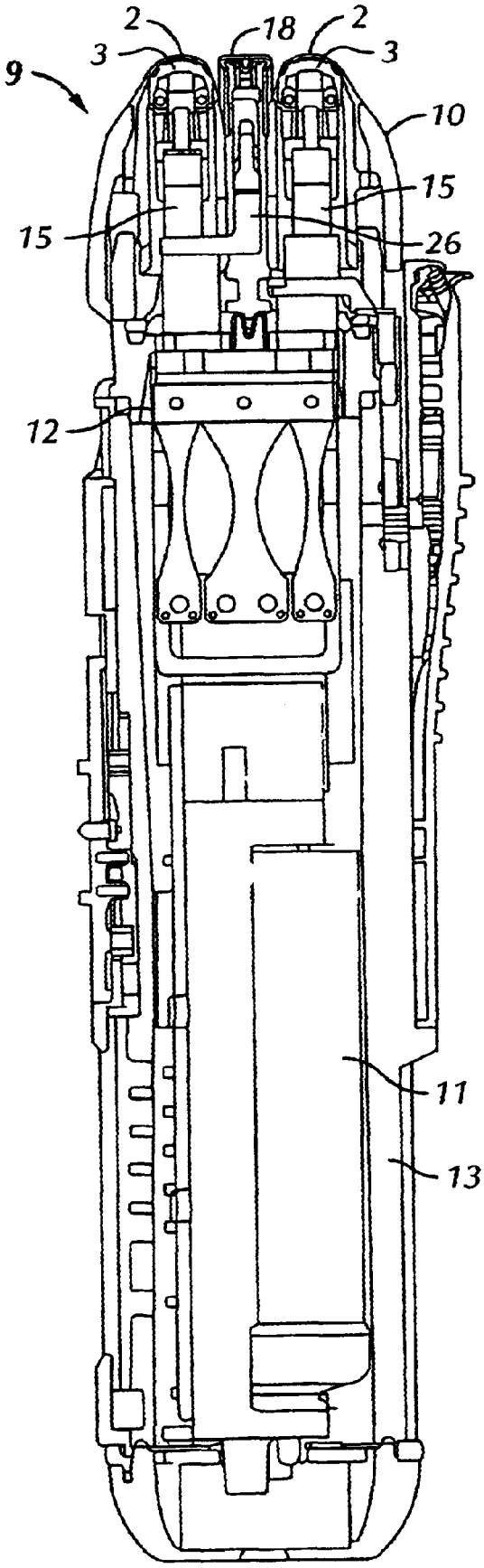
FIG. 1 is a cross-sectional side view of an assembled electric shaver.

Referring now to the drawings wherein like reference characters are used for like parts throughout the several views, the present invention is explained in detail as follows.

Figure 2:
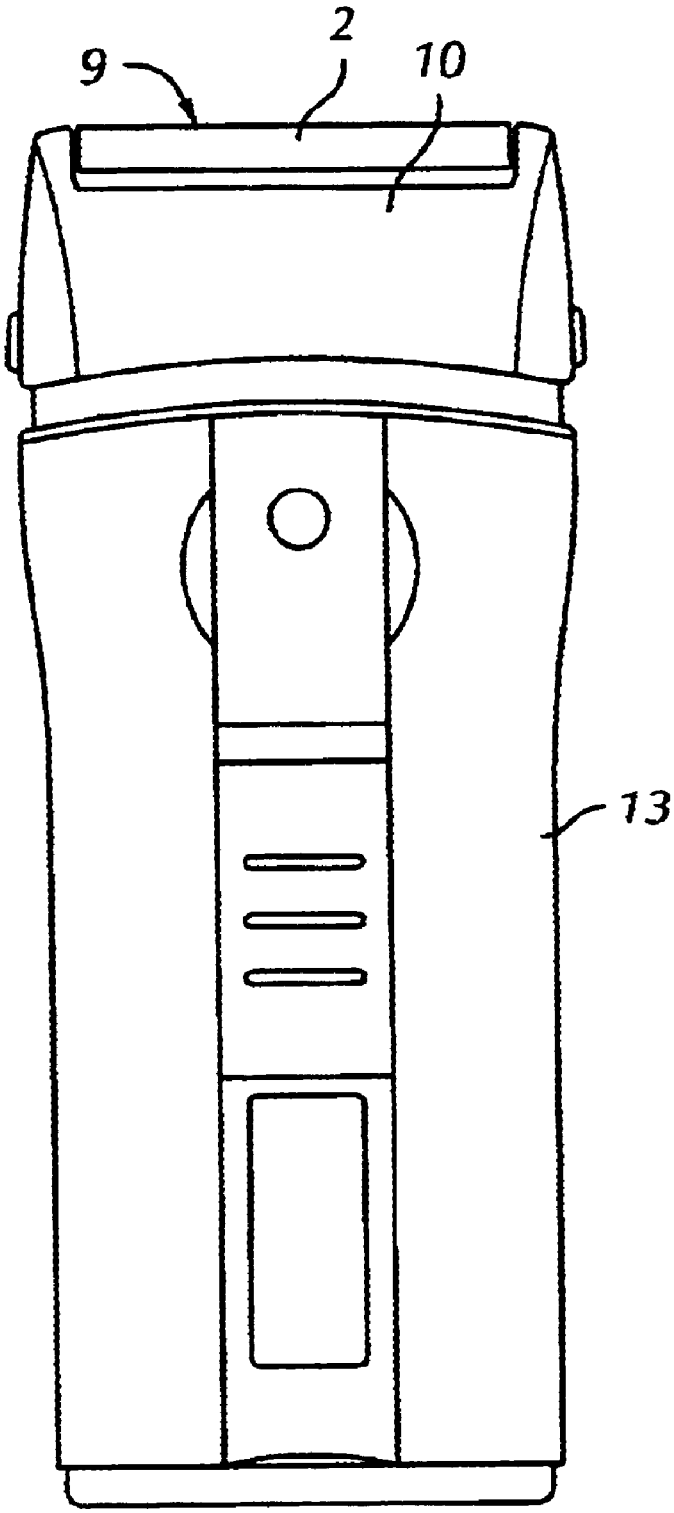
FIG. 2 is a front view of the assembled electric shaver shown in FIG. 1.
Figure 3:
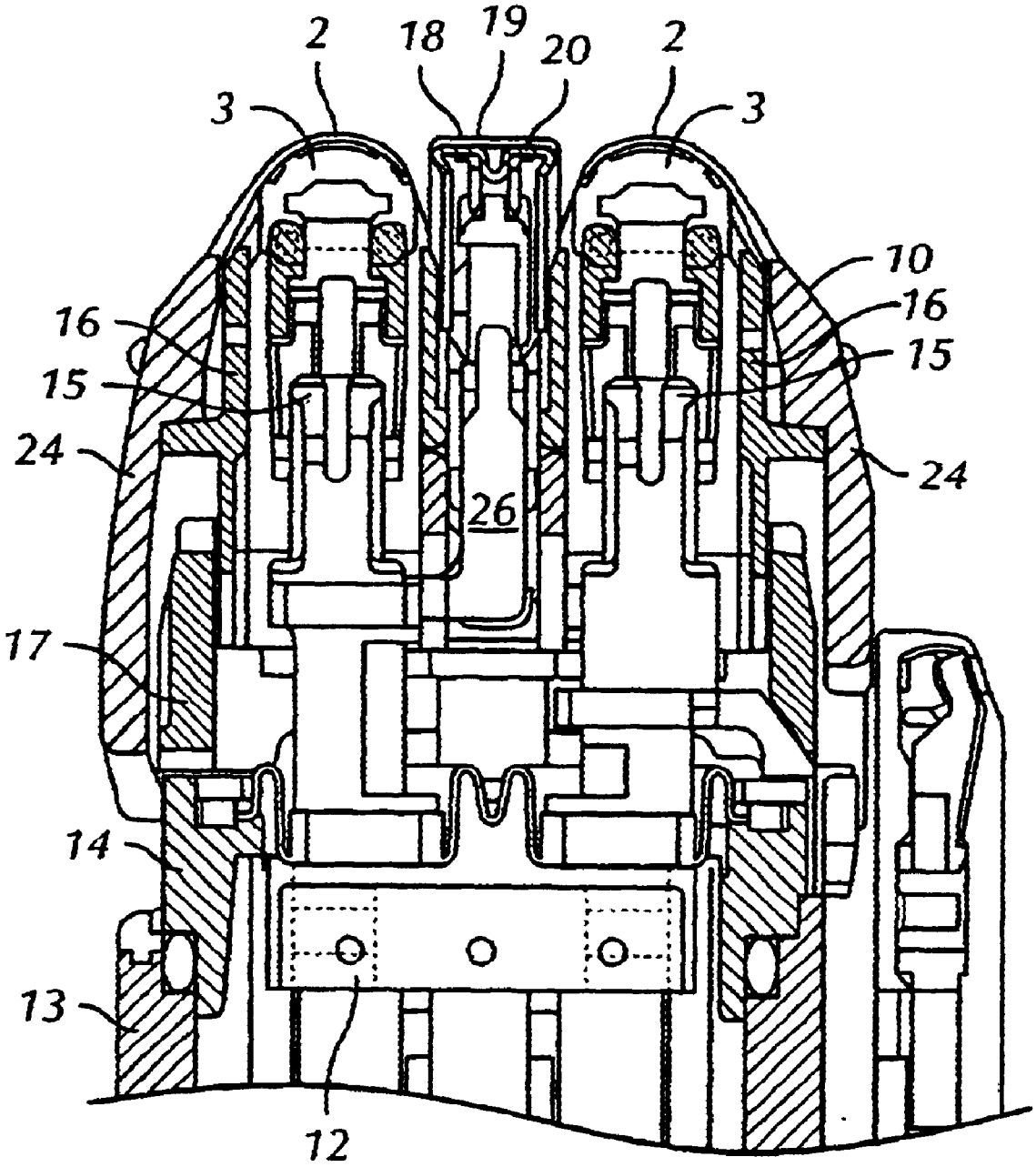
FIG. 3 is an expanded cross-sectional side view of a head of the assembled electric shaver as shown in FIG. 2.
Figure 4:
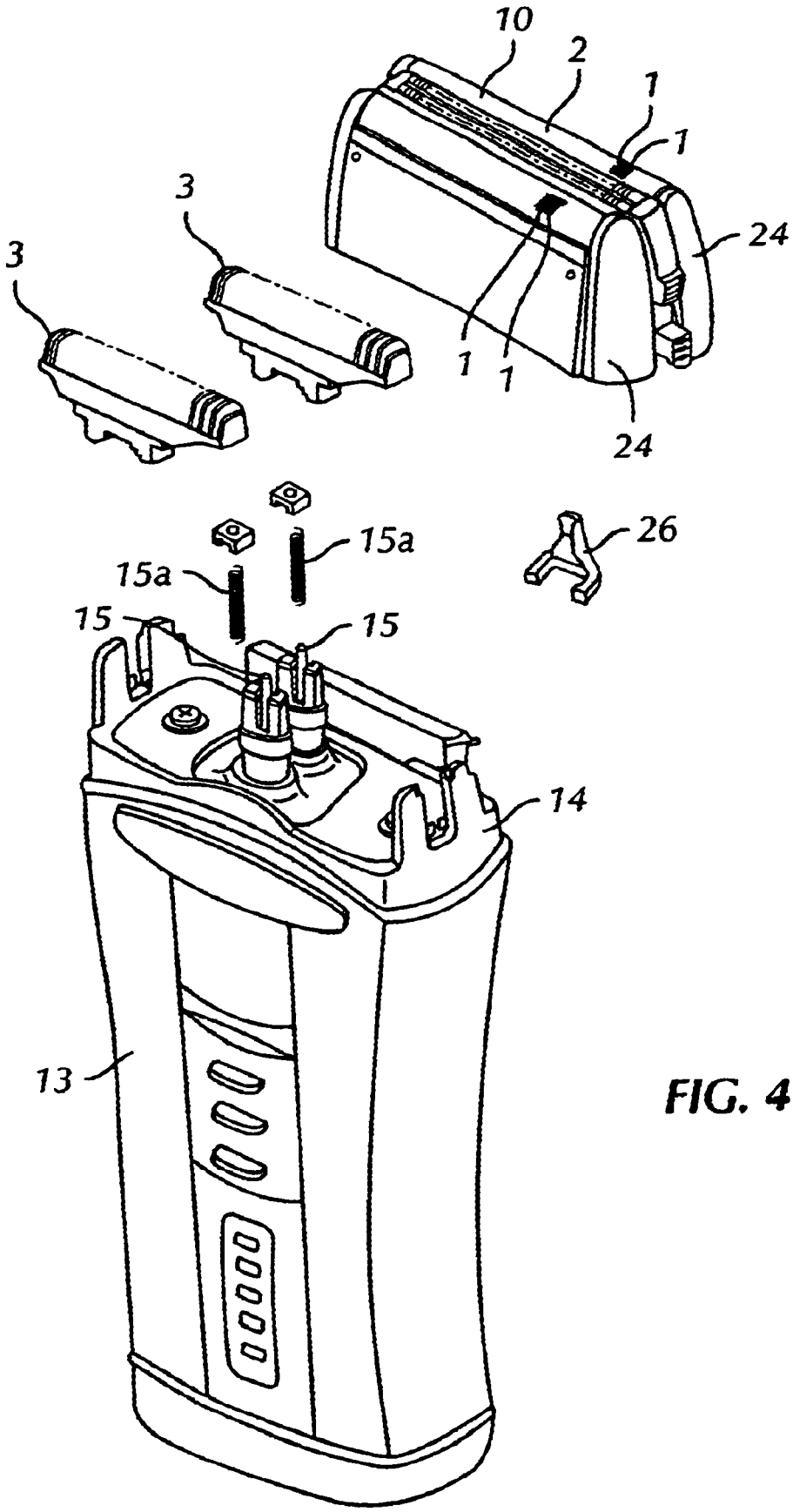
FIG. 4 is a perspective view of a disassembled electric shaver as shown in FIG. 3.
Figure 5:
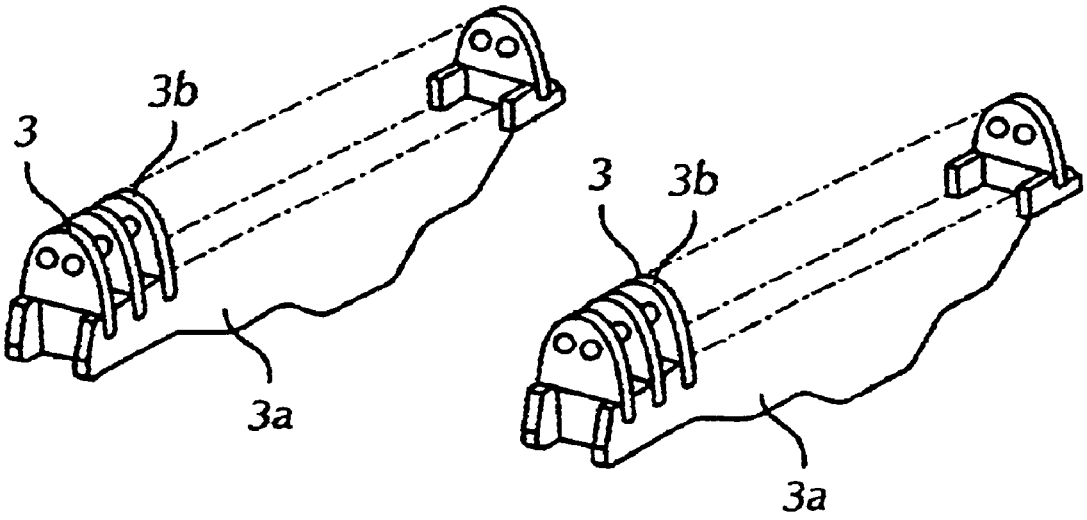
FIG. 5 is a perspective view of an interior blade.

FIG. 1 is a cross-sectional view of an assembled electric shaver showing an embodiment of the present invention. FIG. 2 is a front view of the assembled electric shaver. FIG. 3 is an expanded cross-sectional view of a head (10) of the electric shaver. FIG. 4 is a perspective view of a disassembled electric shaver. FIG. 5 is a perspective view of an interior blade.

As shown in FIG. 1 and FIG. 2, an electric shaver (9) is constructed by attachment of the head (10) to an electric shaver main body (13) containing a battery (11) and a motor (12) such as a linear motor. A frame member (14) is provided upon the upper tip of the electric shaver main body (13). Two drive elements (15) driven by the motor (12) project upward from the upper surface of the frame member (14). As shown in FIGS. 3 and 4, the interior blades (3) are detachably attached to the drive elements (15). The interior blades (3) are elastically pushed upward by interior blade push-up springs (15*a*) as shown in FIG. 4. A slit drive element (26) is attached to one of the drive elements (15).

Figure 6:
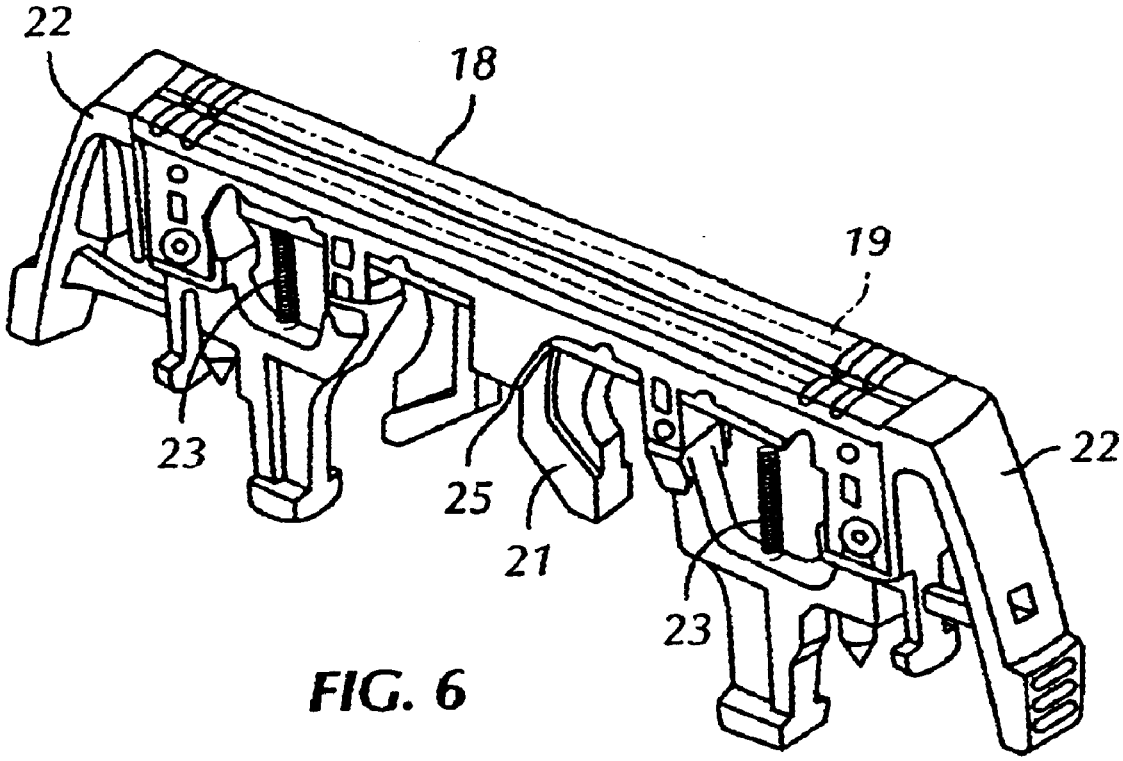
FIG. 6 is a perspective view of an assembled slit blade cassette.
Figure 7:
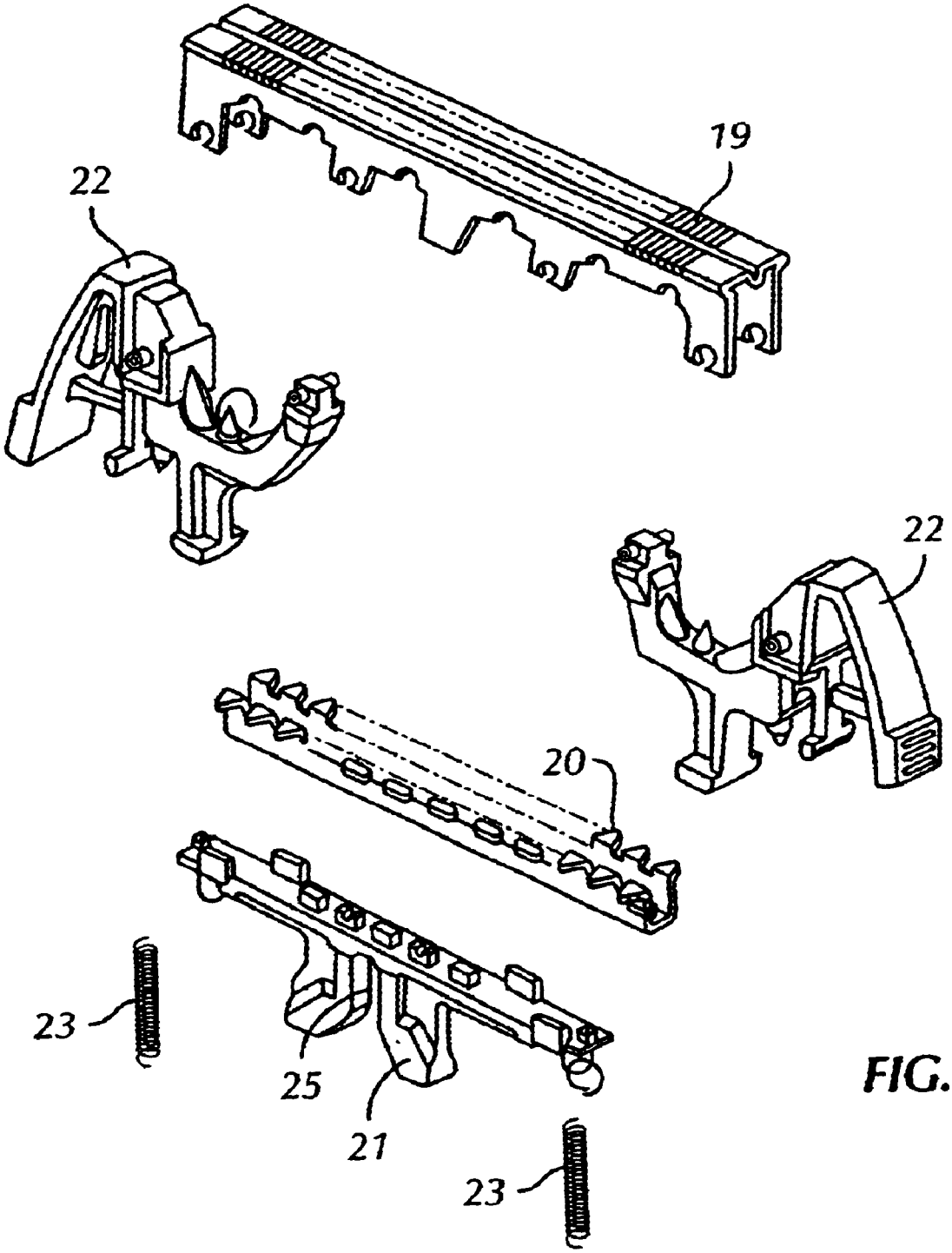
FIG. 7 is a perspective view of the disassembled slit blade cassette.

A sheet-shaped exterior blade (2) (net blade) having a plurality of blade apertures (1) is attached to an exterior blade frame (16) which is supported by a support frame (17) of the head (10) so as to float freely in the vertical direction. A slit blade cassette (18) is attached to the support frame (17) so as to float freely in the vertical direction. This slit blade cassette (18) is elastically supported relative to the support frame (17) by a spring so as to float freely in the vertical direction. As shown in FIG. 6 and FIG. 7, the slit blade cassette (18) comprises a slit exterior blade (19), a slit interior blade (20) (shown in FIG. 7), a slit fitting (21), a slit side frame (22), and a slit push-up spring (23). The slit blade cassette (18) is constructed so that, while the slit interior blade (20) fixed to the bottom surface of the slit fitting (21) contacts the slit exterior blade (19), the slit side frame (22) is attached to the slit exterior blade (19), a bottom surface boss of the slit fitting (21) fits together with an upper surface boss of the slit frame (22), and the slit interior blade (20) rubs freely in elastic contact with the bottom surface of the slit exterior blade (19). A side cover (24) is also attached to the exterior blade frame (16) as shown in FIG. 3.

When the head (10) constructed as described above is attached to the frame member (14) provided at the top of the electric shaver main body (13), the spring force of the interior blade push-up spring (15*a*) causes the interior blade (3), to which the drive element (15) is attached, to rub freely in elastic contact with the bottom surface of the sheet-shaped exterior blade (2) which has a plurality of the blade apertures (1). Also the slit drive element (26), which is attached to one of the drive elements (15), connects to a joint (25) of the slit fitting (21).

When the battery (11) or an alternate power source drives the motor (12), the drive element (15) is driven and repeatedly moves laterally, and the interior blade (3) rubs against the bottom surface of the exterior blade (2). Also due to the slit drive element (26) movement in response to driving of the drive element (15), the slit interior blade (20) laterally rubs against the bottom surface of the slit exterior blade (19). Rough shaving of hair (the beard (31)) is carried out due to rubbing of the slit interior blade (20) against the bottom surface of the slit exterior blade (19), and a rough-shaved beard (31) protrudes from the blade aperture (1) of the exterior blade (2) so that the beard (31) is subsequently cut by the exterior blade (2).

Figure 9:
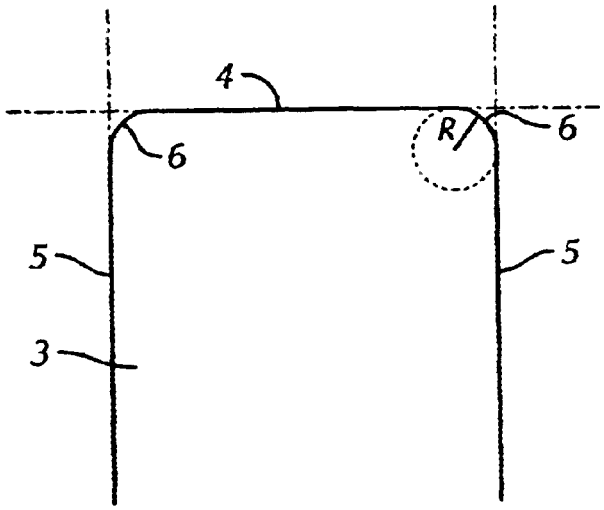
FIG. 9 is an explanatory diagram showing a horizontal surface, a vertical surface and a relief surface of the interior blade.

The electric shaver (9) constructed as described above, as indicated by the interior blade (3) of FIG. 9, has a horizontal surface (4) that rubs against the exterior blade (2) and a vertical surface (5) roughly perpendicular to this horizontal surface (4) according to the embodiment. A relief surface (6) is formed between the horizontal surface (4) and the vertical surface (5) of the interior blade (3).

Figure 10:
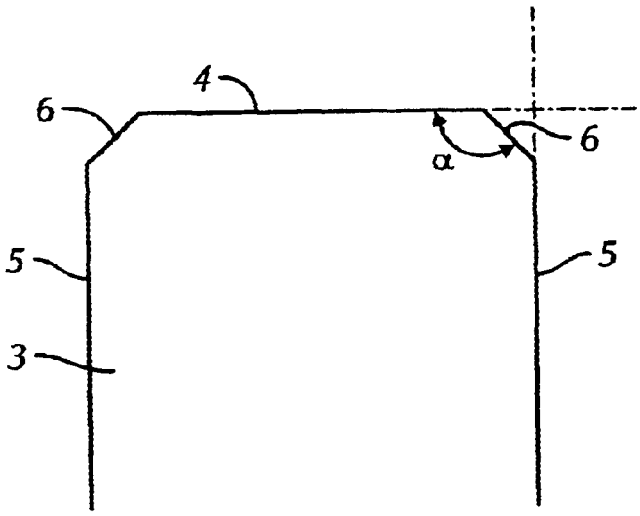
FIG. 10 is an explanatory diagram showing another embodiment of the interior blade.

The above mentioned relief surface (6) formed between the horizontal surface (4) and the vertical surface (5) may have a rounded edge-shape as shown in FIG. 9 or may have a tapered-shape as shown in FIG. 10. The angle $\alpha$ formed by the relief surface (6) with the horizontal surface (4) of the interior blade (3) is at least 90°.

Figure 8:
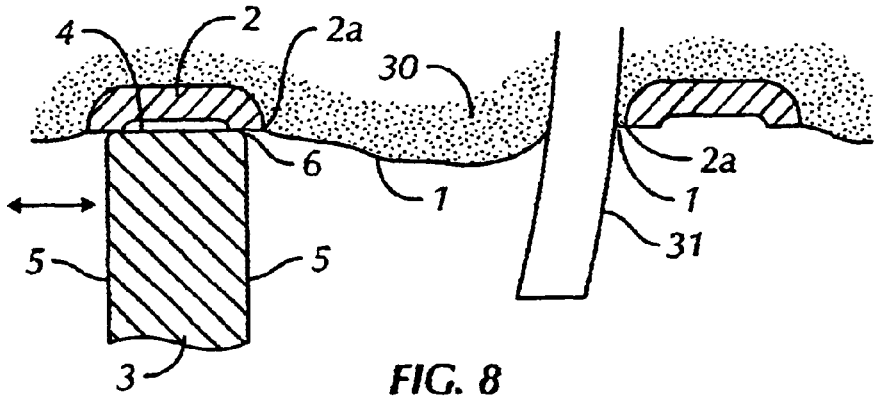
FIG. 8 is an explanatory diagram showing how a human beard is cut using the blade of the electric shaver according to an embodiment of the present invention.

FIG. 8 shows the operation for cutting the beard (31) by the exterior blade (2). Because the relief surface (6) of the interior blade (3) is formed between the horizontal surface (4) which rubs the exterior blade (2) and the vertical surface (5) which is the surface perpendicular to the direction of lateral movement of the interior blade (3), the interior blade (3) can slide over skin (30) without imparting damage to the skin (30). The interior blade (3) moves to the position of an adjacent exterior blade (2) while avoiding damage to the skin (30) in this manner, and the beard (31) is cut by an edge (2*a*) of the adjacent exterior blade (2), almost like cutting a beard by using a scissors formed by the interior blade (without a sharp edge) and exterior blade (with a sharp edge). In this case, the interior blade (3) moves to the position of the adjacent exterior blade (2) and performs the function of holding the beard (31) in place, not the function of cutting the beard (31). Only the exterior blade (2) performs the cutting of the beard (31) by its edge (2*a*). In this manner, even though the interior blade (3) rubs the bottom surface of the exterior blade (2), the conventional sharp blade is not present, and the relief surface (6) slides upon the skin (30). Therefore damage is not imparted to the skin (30) by the interior blade (3), and pleasant beard shaving becomes possible with little irritation to the skin (30).

Figure 11:
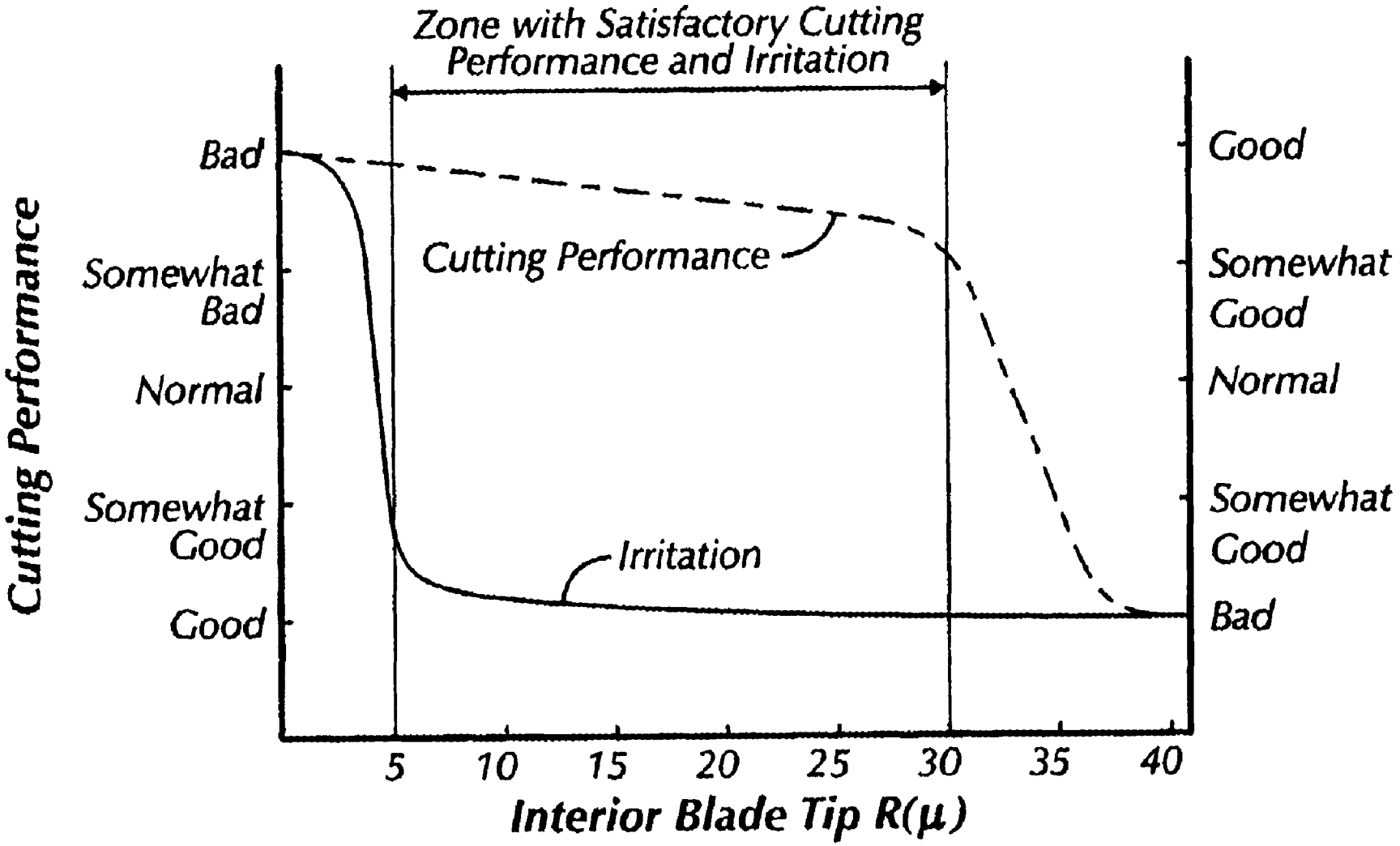
FIG. 11 is a graph showing the relationship among radius (R) of a curvature of the relief surface of the interior blade, stimulations from the blade to human skin, and cutting performance of the blade.

The relief surface (6) cannot be made excessively large because cutting performance worsens. FIG. 11 shows the relationship between a radius of curvature (R) of the relief surface (6), irritation(stimulation), and cutting performance. Although irritation increases when R is less than 5 microns, irritation becomes small at 5 microns or above. However, cutting performance worsens when R exceeds 30 microns. In other words, it is preferable that R is in the range of 5–30 microns for good cutting performance while avoiding irritation.

As shown in FIG. 5, the interior blade (3) is formed of a base member (3*a*) and a plurality of cutting blade members (3*b*). The interior blade (3) may comprise the base member (3*a*) produced by molding and a plurality of the cutting blade members (3*b*) made of metal. The interior blade (3) may comprise the base member (3*a*) and the cutting blade members (3*b*) formed as a single molding. When the interior blade (3) comprises the base member (3*a*) and the cutting blade members (3*b*) formed as a single molding in this manner, the material used for molding can be resin, metal, ceramic, etc. The interior blade (3) can be produced rather easily when resin is used as the molding material. Moreover hardness is high and wear resistance is good when metal is used as the molding material. When ceramic is used as the molding material, hardness is high, wear resistance is good, and rust generation is prevented.

Additionally, the surface of the molding may be treated by coating. When the surface of the molding is coated in this manner, wear resistance is improved in comparison to wear resistance resulting from use of the molding alone. Further, when a porous member is coated, the beard waste adhered to the interior blade (3) can be readily removed.

The mold may contain another constituent materials in order to add functionality. For example, carbon can be added to increase hardness of the mold, or a lubricant, oil, etc. can be added to form an oil-less blade.

Figure 12:
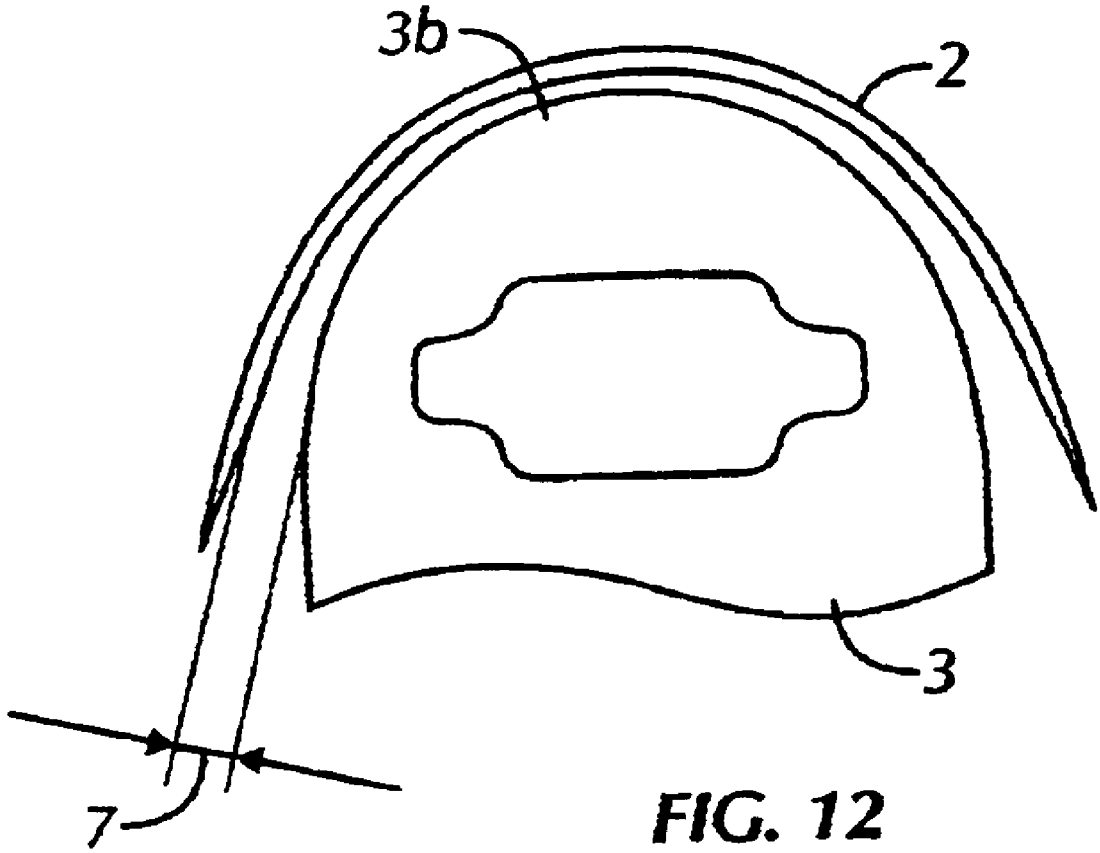
FIG. 12 is a side view of an embodiment showing the formation of a gap between the interior blade and the exterior blade.
Figure 13:
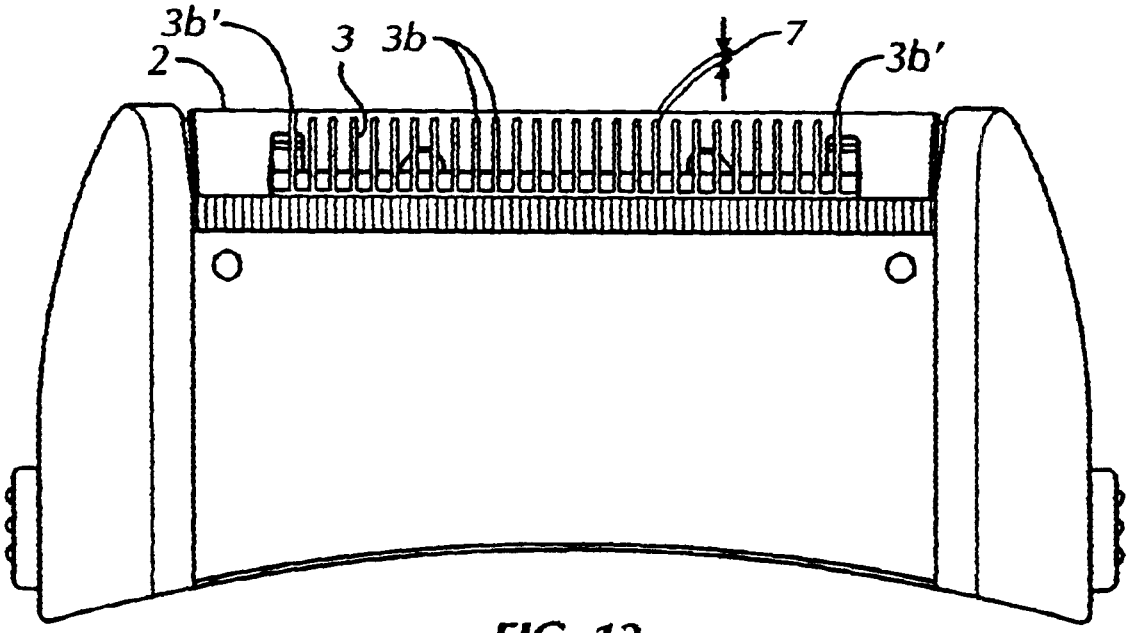
FIG. 13 is a front view of an embodiment showing the formation of a gap between the interior blade and the exterior blade.

FIG. 12 and FIG. 13 show an example of formation of a gap (7) between the interior blade (3) and the exterior blade (2). That is to say, among a plurality of the cutting blade members (3*b*) of the interior blade (3), only those cutting blade members (3*b*') located at either end touch the bottom surface of the exterior blade (2). Therefore, the gap (7) can be formed between the cutting blade members (3*b*) and the exterior blade (2) except at either end of the interior blade (3). Under this configuration, the interior blade (3) and the exterior blade (2) do not interfere to each other so that noise and friction with the cutting blade members (3*b*) are reduced. Because the interior blade (3) does not perform the function of cutting the beard (31), existence of such gap (7) between the interior blade (3) and the exterior blade (2) does not worsen the cutting performance.

Figure 14:
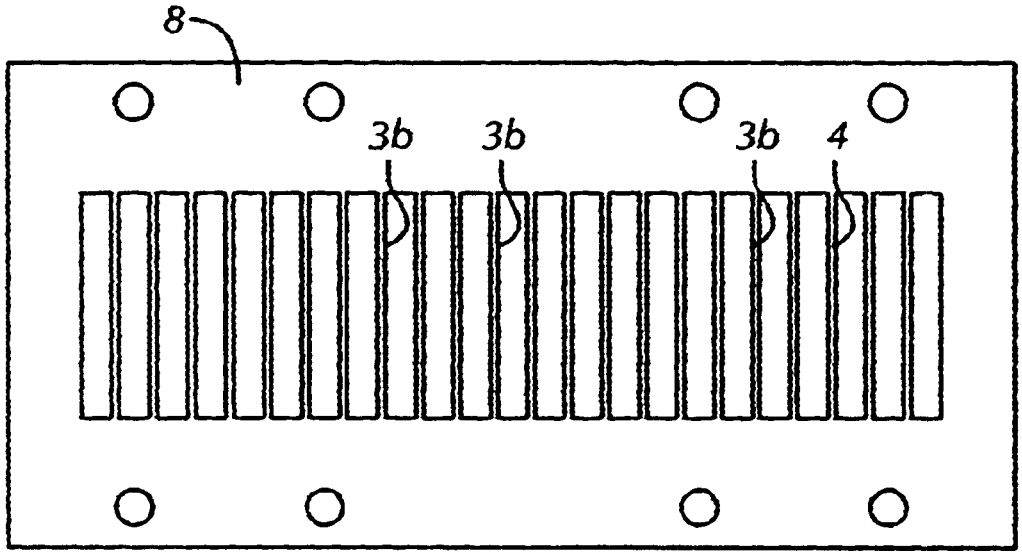
FIG. 14 is a plane view of an apertured flat plate.
Figure 15B:
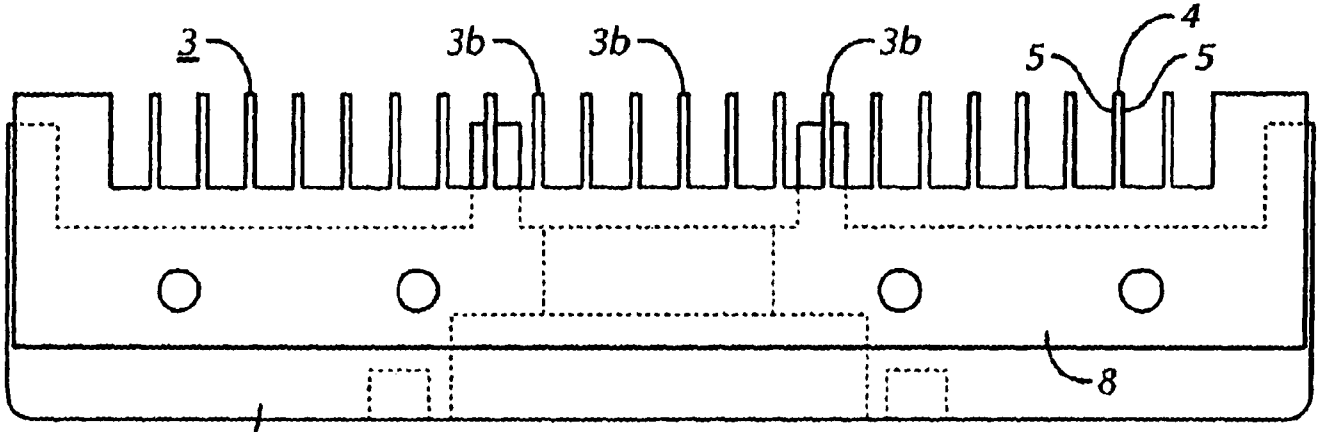
FIG. 15*b* is a front view of an interior blade formed by bending the apertured flat plate.
Figure 15A:
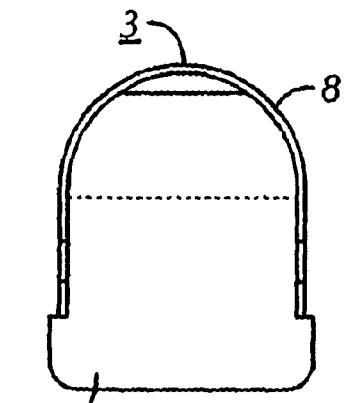
FIG. 15*a* is a side view of the interior blade formed by bending the apertured flat plate.
Figure 16:
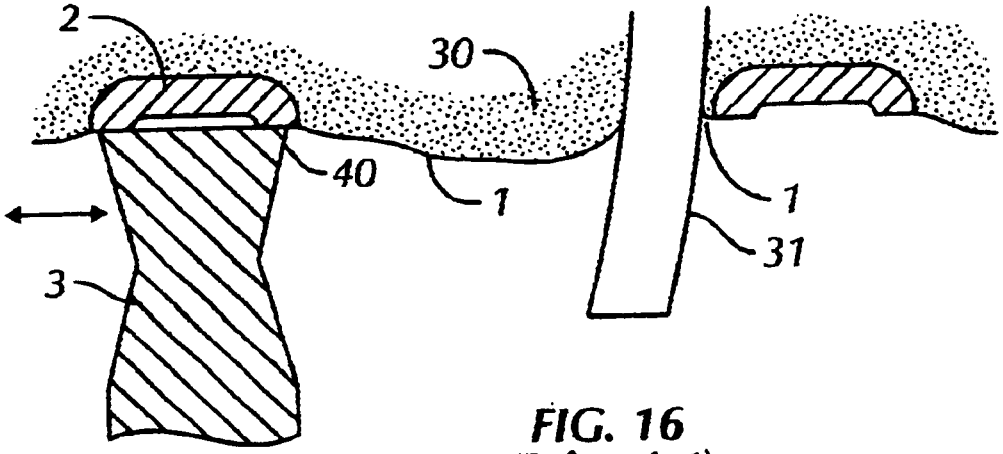
FIG. 16 (Prior Art)
FIG. 16 shows an explanatory drawing showing a how human beard is cut according to prior art.
Figure 17A:
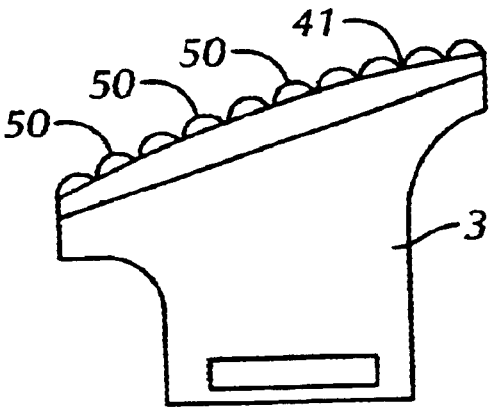
FIG. 17A (Prior Art)
FIG. 17*a* is a front view of an interior blade which is partially provided with convexities along the top end of the blade according to prior art.
Figure 17B:
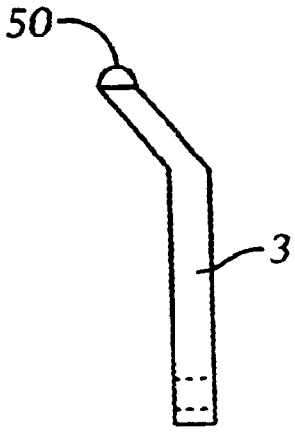
FIG. 17B (Prior Art)
FIG. 17*b* is a side view of the interior blade which is partially provided with convexities along the top end of the blade according to prior art.
Figure 19A:
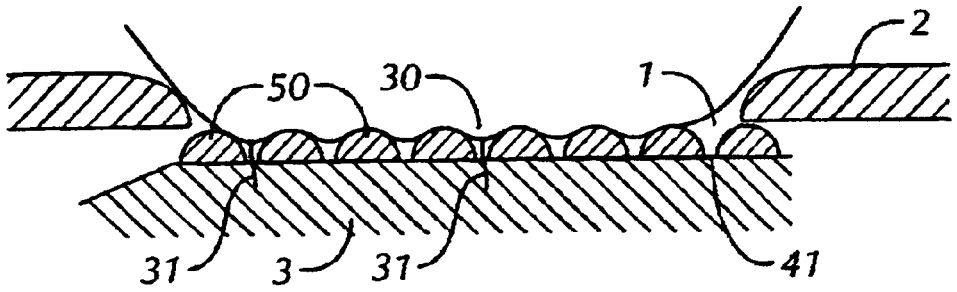
FIG. 19A (Prior Art)
FIG. 19*a* is a cross-sectional view along the line X-Y of FIG. 18 showing how the human beard is cut according to prior art.
Figure 19B:
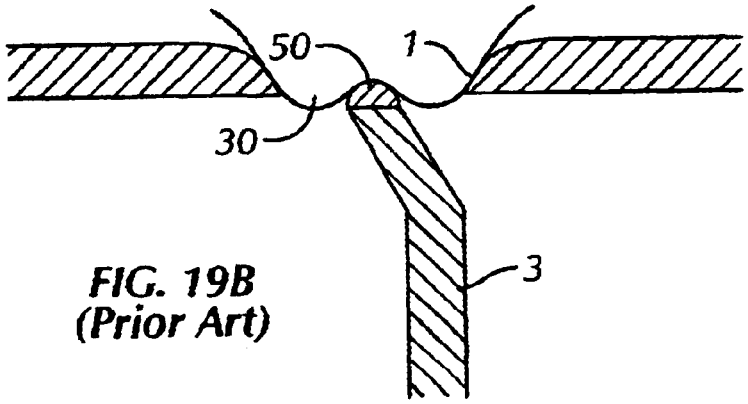
FIG. 19B (Prior Art)
FIG. 19*b* is a cross-sectional view along the line Y—Y of FIG. 18 showing how the human beard is cut according to prior art.
Figure 18:
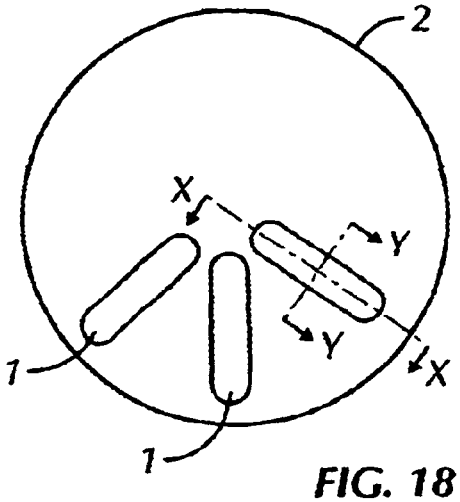
FIG. 18 (Prior Art)
FIG. 18 is a plane view of the exterior blade according to prior art.

Because the interior blade (3) does not require high precision processing such as the conventionally used sharp edge processing, formation becomes possible by bending of an apertured flat plate (8). That is to say, aperturing is carried out by pressing of the flat plate (8) as shown in FIG. 14. Thereafter, the flat plate (8) apertured as shown in FIG. 14 is bent as shown in FIG. 15. The flat plate (8), which has a plurality of the cutting blade members (3*b*) formed in this manner, is bent and attached to the base member (3*a*). In this manner, a curvature can be readily formed as the relief surface (6) between the horizontal surface (4) and the vertical surface (5) of the cutting blade member (3*b*) by punching out during aperturing of the flat plate (8) by pressing.

According to an embodiment of the present invention, the present invention as described above is an electric shaver equipped with a sheet-shaped exterior blade having a plurality of blade apertures and an interior blade that rubs the interior surface of this exterior blade for cutting hair with the interior blade and the sheet-shaped exterior blade, wherein the interior blade is equipped with a horizontal surface and a vertical surface roughly perpendicular to this horizontal surface, and the interior blade is provided with a relief surface between the horizontal surface and the vertical surface of the interior blade. Therefore, the tip of the interior blade lacks the conventional sharp edge, and damage is not imparted to the skin even when considerable skin projects from the blade aperture of the exterior blade. Because damage is not imparted to the skin even when considerable skin projects from the blade aperture of the exterior blade, the amount of skin projection becomes unrestricted. Therefore, blade aperture and blade thickness of the exterior blade can be freely set without concern for irritation to the skin, the beard can be cut shorter, and cutting performance improves. Also because the conventional sharp edge is not required at the tip of the interior blade, the interior blade can be readily processed without requiring the precise processing, and concern over injury resulting from the sharp edge during cleaning disappears.

According to an embodiment of the present invention, because of the existence of the rounded edge-shaped relief surface, sliding upon the skin surface improves, battery life can be prolonged due to lessening of load, and the relief surface can be readily manufactured, for example, by tumble-barreling, sand-shot blasting, etc. of a punch-out produced by a punch press.

According to an embodiment of the present invention, the present invention sets the angle between the horizontal surface of the interior blade and the relief surface at greater than 90°, thereby improving sliding performance upon the skin surface and prolonging battery life due to lessening of load. Also ready manufacture of the relief surface is possible, for example, by lancing, etc.

According to an embodiment of the present invention, because the radius (R) of curvature of the relief surface is set from 5 to 30 microns, good cutting performance is achieved while avoiding irritation.

According to an embodiment of the present invention, the present invention constructs the interior blade as a molding so that interior blade construction and manufacture can be simplified by producing a base member and a cutting blade member simultaneously as a single molding.

According to an embodiment of the present invention, the interior blade is provided by molding process using resin, metal, ceramic, or a surface-coated molding material. Therefore, manufacture from resin as molding material can be readily carried out using a metallic mold. When metal is used as the molding material, hardness increases, and wear resistance improves. When ceramic is used as the molding material, hardness increases, wear resistance improves, and rusting is prevented. By use of a coating on the surface, wear resistance can be improved relative to use of a molding alone. When a porous material member is coated, the beard waste adhered to the interior blade (3) can be readily removed.

According to an embodiment of the present invention, the interior blade is produced by using a constituent material in order to add functionality such as, for example, carbon to increase hardness of the molding, or a lubricant for formation of an oil-less blade.

According to an embodiment of the present invention, a gap is formed between the interior blade and the exterior blade, thereby avoiding interference between the interior blade and the exterior blade, reducing noise, and reducing friction between the interior blade and the exterior blade so that working life can be prolonged.

According to an embodiment of the present invention, the interior blade is produced by bending of an apertured flat plate, thereby simplifying construction of the interior blade which can be formed from flat plate, thereby making it possible to readily and inexpensively provide an interior blade.

While the present invention has been described with respect to a limited number of preferred embodiments, those skilled in the art will appreciate numerous modifications and variations therefrom. The appended claims are intended to cover all such modifications and variations which occur to one of ordinary skill in the art.

What is claimed is:

1. A blade of an electric shaver, comprising:

an interior blade detachably attached to a drive element of the electric shaver via an interior blade pushing-up means, the interior blade having a horizontal surface, a vertical surface, and a relief surface provided between the horizontal surface and the vertical surface, and elastically pushed upward by the interior blade pushing-up means; and a sheet-shaped exterior blade having a plurality of blade apertures, a bottom surface of the exterior blade elastically contacted with the horizontal surface of the interior blade by a pushing force of the interior blade pushing-up means;

wherein, upon driving the drive element, the interior blade is moved laterally such that the horizontal surface of the interior blade rubs against the bottom surface of the exterior blade, and hair introduced into the blade aperture of the exterior blade is held between the horizontal surface of the interior blade and the exterior blade in accordance with a lateral movement of the interior blade and cut by an edge of the exterior blade, wherein only the cutting blade members formed at both side ends of the interior blade contact the bottom surface of the exterior blade and the gap exists between a bottom surface of the exterior blade and a top end of the remaining cutting blade members.

2. The blade of an electric shaver according to claim 1, wherein the relief surface of the interior blade is formed in a rounded edge-shape having a predetermined radius of curvature.

3. The blade of an electric shaver according to claim 2, wherein the radius of curvature of the relief surface is from $5\mu$ to $30\mu$.

4. The blade of an electric shaver according to claim 1, wherein the interior blade comprises a plurality of cutting blade members disposed in a manner such that the plurality of cutting blade members elastically contact the bottom surface of the exterior blade.

5. The blade of an electric shaver according to claim 4, wherein a selected number of the cutting blade members are configured such that a gap exists between a top end of the cutting blade members and the bottom surface of the exterior blade.

6. A method of shaving hair by using a blade of an electric shaver which comprises an interior blade and a sheet-shaped exterior blade, the interior blade detachably attached to a drive element of the electric shaver via an interior blade pushing-up means and having a horizontal surface, a vertical surface, and a relief surface formed between the horizontal surface and the vertical surface, the exterior blade having a plurality of blade apertures, a bottom surface of the exterior blade elastically contacted with the horizontal surface of the interior blade by a pushing force of the interior blade pushing-up means, the method comprising:

driving the drive element such that the horizontal surface of the interior blade is moved laterally to rub the bottom surface of the exterior blade; and contacting an outer surface of the exterior blade with human skin having a beard such that the beard is introduced into a blade aperture of the exterior blade;

wherein the beard thus introduced into the blade aperture is held between the interior blade and the exterior blade in accordance with a lateral movement of the interior blade and cut by an edge of the exterior blade, wherein only the cutting blades formed at both side ends of the interior blade contact the bottom surface of the exterior blade and a gap exists between a bottom surface of the exterior blade and a top end of the remaining cutting blade members.

7. The method according to claim 6, wherein the relief surface is formed in a round edge-shape having a predetermined radius of curvature.

8. The method according to claim 7, wherein the radius of curvature of the relief surface is from $5\mu$ to $30\mu$.

9. The method according to claim 6, wherein the interior blade comprises a plurality of cutting blade members in a manner that the plurality of cutting blade members elastically contact the bottom surface of the exterior blade.

10. The method according to claim 6, wherein a selected number of the cutting blade members are configured such that a gap exists between a top end of the cutting blade members and the bottom surface of the exterior blade.

11. An electric shaver, comprising:

a main body having a motor therein;

a frame member disposed on a top of the main body;

a drive element projecting upward from an upper surface of the frame member and driven by the motor;

an interior blade detachably attached to the drive element via an interior blade pushing-up means, the interior blade having a horizontal surface, a vertical surface, and a relief surface provided between the horizontal surface and the vertical surface, and elastically pushed upward by the interior blade pushing-up means;

a head attached to the frame member to cover the interior blade, the head comprising a sheet-shaped exterior blade having a plurality of blade apertures attached to the head, the bottom surface of the exterior blade elastically contacting with the horizontal surface of the interior blade;

wherein, upon driving the drive element, the interior element moves laterally such that the horizontal surface of the interior blade rubs against the bottom surface of the exterior blade, and a human beard introduced into the blade aperture of the exterior blade is held between the horizontal surface of the interior blade and the exterior blade in accordance with a lateral movement of the interior blade and cut by an edge of the exterior blade, wherein only the cutting blade members formed at both side ends of the interior blade contact the bottom surface of the sheet-shaped exterior blade and a gap exists between the bottom surface of the exterior blade and the top end of the remaining cutting blade members.

12. The electric shaver according to claim 11, wherein the relief surface is formed in a rounded edge-shape having a predetermined radius of curvature.

13. The electric shaver according to claim 12, wherein the radius of curvature of the relief surface is from $5\mu$ to $30\mu$.

14. The electric shaver according to claim 11, wherein the interior blade comprises a plurality of cutting blade members in a manner that the plurality of cutting blade members contact the bottom surface of the exterior blade.

15. The electric shaver according to claim 11, wherein a selected number of the cutting blade members are configured such that a gap exists between a top end of the cutting blade members and the bottom surface of the exterior blade.

* * * * *

UNITED STATES PATENT AND TRADEMARK OFFICE

CERTIFICATE OF CORRECTION

PATENT NO. : 6,637,113 B2
DATED : October 28, 2003
INVENTOR(S) : Toshio Ikuta et al.

It is certified that error appears in the above-identified patent and that said Letters Patent is hereby corrected as shown below:

Column 7,
Line 61, please amend "the gap" to -- a gap --.

Signed and Sealed this

Thirteenth Day of April, 2004

JON W. DUDAS
*Acting Director of the United States Patent and Trademark Office*